United States Patent [19]

Arnold

[11] 4,078,883

[45] Mar. 14, 1978

[54] GRATE PLATE WITH REPLACEABLE WEAR SURFACES DEVOID OF INDEPENDENT CONNECTORS

[75] Inventor: Hellmut Arnold, Metzkausen, Germany

[73] Assignee: Claudius Peters AG, Hamburg, Germany

[21] Appl. No.: 701,245

[22] Filed: Jun. 30, 1976

[30] Foreign Application Priority Data

Jul. 4, 1975 Germany ..... 7521218[U]

[51] Int. Cl.[2] ..... F27D 3/00

[52] U.S. Cl. ..... 432/239; 34/164

[58] Field of Search ..... 432/134, 235, 239; 34/164, 237

[56] References Cited

U.S. PATENT DOCUMENTS

| | | | |
|---|---|---|---|
| 3,374,553 | 3/1968 | Gillman | 34/164 |
| 3,753,299 | 8/1973 | Schreiner | 34/164 |
| 3,861,659 | 1/1975 | Evenstad | 432/239 |

*Primary Examiner*—John J. Camby
*Attorney, Agent, or Firm*—Otto John Munz

[57] ABSTRACT

A longitudinally reciprocating grate plate in a substantially horizontal plane for an apparatus for heat variation, such as for cooling or combustion, forming a bed for forwarding a flow of material comprising a one-piece frame shaped base plate with an upper substantially flat surface portion and a slightly rising portion in the direction of flow of said material over said grate, the base plate provided with hollows, internal recesses and protrusions, a plurality of rib-shaped wear pieces to provide a long-life wear surface to the plate in its plane, the wear pieces disengageably assembled with the base plate provided with internal protrusions and recesses in assembly mating with the hollows, recesses and protrusions respectively, of the plate in a snug, easily assembled loose fit and devoidly of any additional independent connecting means such as screws, bolts or welds. The base plate and the wear pieces in assembly are forming slots substantially in the vertical direction to form jet-type air ducts.

10 Claims, 2 Drawing Figures

GRATE PLATE WITH REPLACEABLE WEAR SURFACES DEVOID OF INDEPENDENT CONNECTORS

CROSS-REFERENCE TO A RELATED APPLICATION

Priority of German application No. G 75 21 218.9 filed July 4, 1975 is claimed under the Convention.

BACKGROUND OF THE INVENTION

1. FIELD OF THE INVENTION

A grate plate for the purpose of cooling or combustion having a bearing surface substantially flat or rising slightly in the direction of the flow of the material to be moved over it, equipped with replaceable wear pieces (Class 34/Subclass 237).

2. DESCRIPTION OF THE PRIOR ART

Cooling and combustion grates conventionally are equipped with overlapping grate plates, some of which are mounted in fixed positions with others for back and forth movements in a longitudinal direction. The air needed for cooling or combustion passes from below through jet-like openings in the plate and through the bed of material deposited on it.

Grate plates which are designed as units and pieces cast of a single-type cast material selected to meet the requirements of the operation, wear satisfactorily at normal mechanical and thermal demands. An assembly of two-piece grate plates is employed for replacement purposes, when an extensive mechanical and thermal wear is expected, the two pieces of the grate plate being attached to each other with screws by means of connection, whereby the worn-out front piece of such a grate plate may be replaced as needed.

Prior art also discloses a grate plate having the piece which is most exposed to wear provided with a ribbed wear surface. This wear piece is hooked into the base plate by means of a hook-like projection and in addition is welded to the front portion of the base plate. The wear piece can be manufactured from highly wear-resistant material and the base plate may be cast from a less wear-resistant substance.

Another type of a grate plate has a heat-resistant cast base plate and a head piece made of ceramic material with removable means of assembly of the two pieces.

In the oldest prior art combustion grates were mentioned with which are used exchangeable combustion parts inserted into the surface of level grates and attached thereto with screws.

All of the aforementioned grate plates have the disadvantage that their wear pieces are connected to the base plate by some definite means of attachments such as separate screws and the exchange of these pieces therefore is cumbersome.

U.S. Pat. No. 3,753,299 of Aug. 21, 1973 is made of record as a representative prior art.

The objects of the invention are:

to provide a grate plate for an apparatus for cooling or combustion moving material over it which has:

the wear suffering parts easily replaceable; and the wear pieces and base plate without separate means of attachment such as screws;

the wear piece loosely inserted into the base plate to facilitate an easy and quick exchange.

Other objects and advantages of the invention will become apparent from the following description taken in conjunction with the drawings and claims.

DESCRIPTION OF THE PREFERRED EMBODIMENTS

Figures 1, 2:
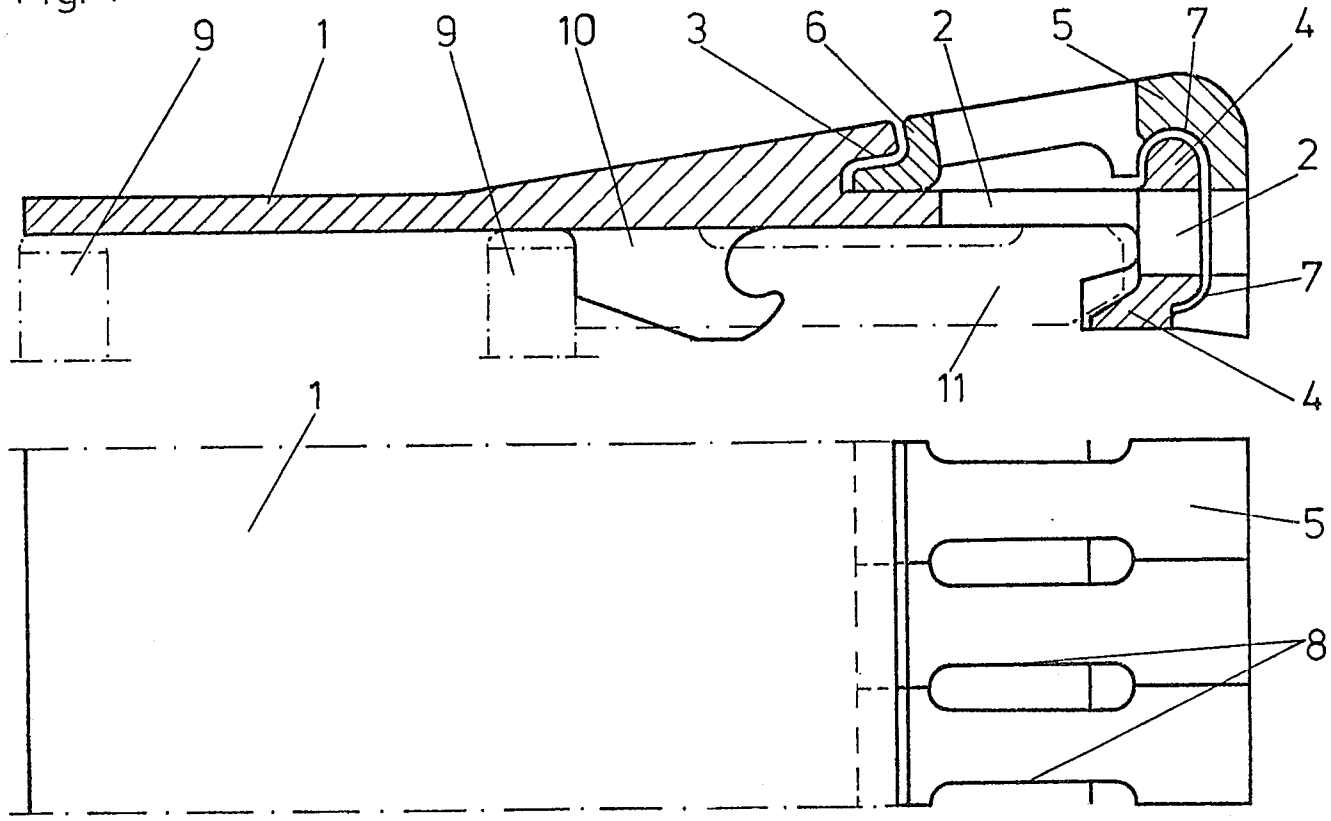
FIG. 1 shows a longitudinal cross-section through a grate plate.
FIG. 2 shows a partial top view of the grate plate of FIG. 1.

The grate plate of the invention has a one-piece frame-like base plate with rod-shaped wear pieces which are loosely but snugly inserted into the plate from the side or superimposed through it. By this construction of the base plate it is not only possible to exchange the wear pieces easily, without disengaging a screwed or welded connection, but it is also possible to merely exchange and replace individual adjoining worn-out rib-shaped wear pieces. The base plate has means to mount the grate piece on it and recesses and protrusions for holding and guiding the wear pieces and orifices for air supply at the top and the front sides. These orifices for air supply are jet-like and direct the air for cooling or combustion from below in an upward direction.

The wear pieces are narrower at their top and front sides to conform with the orifices for air ducts at the top and front sides of the base plate. The wear pieces themselves may have orifices for air supply on their top and front sides which conform with the orifices for the air ducts of the base plate.

The surfaces of the wear pieces when inserted or superimposed are in the same plane with the surface of the base plate avoiding unevennesses in the surface of the grate plate, such as elevations and depressions which would hinder the directional flow of travel of the material on the back and forth reciprocating grate plate and which would furthermore increase the wear by friction. It is particularly important for the maintenance of the oscillating grate that the base and wear pieces do not have any separate means for mutual attachment such as screws.

As shown in the drawings the grate assembly has a base plate 1 with a plane rear portion 1*a* and a slightly upward inclined front portion 1*b*. In the front portion and on its head the base plate has orifices 2, for air supply. There is a recess 3 provided on the surface of the base plate substantially coplanar with the plane of the rear portion thereof and the front side is equipped with substantially vertical protrusions 4. The recess and the protrusion serve to guide loosely and hold snugly matingly-shaped wear-rods 5, inserted from the side. The wear rods, which are cast of a material of higher quality than that of the base plate, have protrusions 6 and recesses 7 which fit into the recesses and over the protrusions of the base plate. The wear rods 5 as shown in FIG. 2, are inserted parallel to each other into the frame-like base plate, and are equipped with adjoining recesses 8, two of which correspond to the orifices for air supply 2 of the base plate and serve as orifices for the air supply.

The wear rods 5 are inserted from the side into the base plate and lie unattached next to each other, an attachment of the wear rods lying on the outside of a grate plate being unnecessary because the wear rods cannot drop sideways from their mount when a grate plate is mounted next to another grate plate.

In the preferred embodiment the grate plates rest on supports 9. On the underside of base plate 1, preferably attachment means such as hooks 10 are provided into which fit bolts for the attachment to the grate support.

Optionally a grate support finger 11, shown in broken lines, serves as attachment for the grate plate. The grate plate may be attached to the grate support in any other known manner of attachment.

What is claimed is:

1. A grate plate for an apparatus such as for cooling or combustion, to be mounted in the apparatus for reciprocation in the plane adapted to be in the direction of the flow of material in such apparatus, to be moved over or rising slightly above said plane, comprising:

a frame-like one piece base-plate having a side and provided with hollows and having mounting means for holding said base plate in the direction of flow of material and replaceable rod-shaped wear-pieces, having a shape matingly conforming with the hollows of said base plate to permit their insertion into said plate, from the side unattached to each other.

2. A grate plate as claimed in claim 1, the base plate and the wear pieces provided with protrusions and recesses for guiding the wear pieces into the base plate and for holding them in the base plate.

3. A grate plate as claimed in claim 1, said plate with said hollows including recesses and protrusions for the guiding the wear pieces transversely to the direction of flow of said material, and said hollows, recesses and protrusions shaped to provide vertical air ducts in assembly with said wear pieces.

4. A grate plate as claimed in claim 1, said plate with said hollows including recesses and protrusions for guiding the wear pieces into the said plate from above and holding them in that position, said hollows, recesses and protrusions shaped to provide vertical air-ducts in assembly with said wear pieces.

5. A grate plate as claimed in claim 1, further comprising:

a plate support, and means for holding the base plate to said plate support.

6. A grate plate as claimed in claim 2, further comprising:

air-ducts at the top and top sides, the wear pieces having narrow upper- and head-portions providing in assembly with said base plate orifices for the said air-ducts.

7. A grate plate as claimed in claim 1, further comprising orifices for air-ducts, the wear pieces having recesses at their top and head sides with slots conforming in alignment with the orifices for the air ducts of the base plate.

8. A grate plate as claimed in claim 1, the surfaces of the wear pieces assembled therewith forming one plane with the surface of the base plate.

9. A grate plate as claimed in claim 1, the base plate and the wear pieces being devoid of independent means for mutual attachment.

10. A longitudinally reciprocating grate plate in a substantially horizontal plane for an apparatus for heat variation, such as for cooling or combustion, forming a bed for forwarding a flow of material, comprising:

a base plate with an upper substantially flat surface portion and a slightly rising portion in the direction of flow of said material over said grate, said base plate provided with hollows, internal recesses and protrusions;

a plurality of rib-shaped wear pieces to provide a long-life wear surface to said plate in its plane, said wear pieces disengageably assembled with said base plate provided with internal protrusions and recesses in assembly mating with the hollows, recesses and protrusions respectively of said plate in a snug, easily assembled loose fit and devoidly of any additional independent connecting means such as screws, bolts or welds, said base plate and said wear pieces in assembly forming slots substantially in the vertical direction, to form jet-type air-ducts.

* * * * *